US006571907B2

(12) United States Patent
Jennings

(10) Patent No.: US 6,571,907 B2
(45) Date of Patent: Jun. 3, 2003

(54) PORTABLE ACOUSTIC HEARING ENHANCEMENT DEVICE

(75) Inventor: Fred C. Jennings, Corona del Mar, CA (US)

(73) Assignee: The Jennings Company, Corona Del Mar, CA (US)

( * ) Notice: Subject to any disclaimer, the term of this patent is extended or adjusted under 35 U.S.C. 154(b) by 52 days.

(21) Appl. No.: 09/952,230

(22) Filed: Sep. 11, 2001

(65) Prior Publication Data

US 2003/0047375 A1 Mar. 13, 2003

(51) Int. Cl.[7] ..... G10K 11/28
(52) U.S. Cl. ..... 181/136; 181/129
(58) Field of Search ..... 181/133, 136, 181/129; 381/385; 2/209

(56) References Cited

U.S. PATENT DOCUMENTS

| | | | |
|---|---|---|---|
| 12,951 A | 5/1855 | Hyde | |
| 16,485 A | 1/1857 | Hyde | |
| 30,688 A | 11/1860 | Page | |
| 177,984 A | 5/1876 | Batchelder | |
| 1,502,666 A | 7/1924 | Grady, Jr. | |
| 1,640,908 A | 8/1927 | Schucker | |
| 2,537,201 A | 1/1951 | Amfitheatrof | |
| 2,908,766 A | 10/1959 | Taylor | |
| 3,452,836 A | 7/1969 | Carsello et al. | |
| 3,512,605 A | 5/1970 | McCorkle | |
| 3,618,698 A | 11/1971 | McCabe et al. | |
| 3,938,616 A | 2/1976 | Brownfield | |
| 4,421,199 A | 12/1983 | Vrana | |
| 4,516,656 A | 5/1985 | Fleshler | |
| 4,574,912 A | 3/1986 | Fuss et al. | |
| D292,916 S | 11/1987 | Ikeda | |
| 4,768,613 A | 9/1988 | Brown | |
| 4,771,859 A | 9/1988 | Breland | |
| 4,997,056 A | 3/1991 | Riley | |
| 5,020,629 A | 6/1991 | Edmundson et al. | |
| 5,189,265 A | 2/1993 | Tilkens | |
| 5,345,512 A | 9/1994 | Lee | |
| 5,661,270 A | 8/1997 | Bozorgi-Ram | |
| 5,965,850 A | 10/1999 | Fraser | |
| 6,082,486 A | 7/2000 | Lee | |
| 6,234,446 B1 * | 5/2001 | Patterson | 381/385 |
| 6,237,714 B1 | 5/2001 | Lee | |

FOREIGN PATENT DOCUMENTS

| | | |
|---|---|---|
| WO | WO 98/06232 | 2/1998 |

OTHER PUBLICATIONS

Leland A. Watson, et al., *Hearing Tests And Hearing Instruments*, Chapter XIII, *The Modern Hearing Aid*, The Williams & Wilkins Company, 1949, pp. 268–270.

Kenneth W. Berger, *The Hearing Aid: Its Operation and Developement*, The National Hearing Aid Society, 1974, pp. v and 7–23.

Kenneth W. Berger, Ph.D., *Early Bone Conduction Hearing Aid Devices, Arch Otolaryngol*, vol. 102, May 1976, pp. 315–318.

* cited by examiner

*Primary Examiner*—Khanh Dang
(74) *Attorney, Agent, or Firm*—Knobbe, Martens, Olson & Bear, LLP

(57) ABSTRACT

A portable, non-electronic hearing enhancement system collects sound from the front of the user and directs it towards the user's ears through the use of a pair of sound reflectors mounted on support bands. The sound reflectors are positioned behind a user's ears by adjusting the positions of the support bands on the headrest of a seat. The support bands are held in place on the seat by the weight of the support bands and by friction. Thus, the hearing enhancement system can be used without marring the fabric or other surface material of the headrest.

7 Claims, 4 Drawing Sheets

PORTABLE ACOUSTIC HEARING ENHANCEMENT DEVICE

BACKGROUND OF THE INVENTION

1. Field of the Invention

The present invention relates generally to sound enhancement devices, and more particularly to portable acoustic or non-electronic hearing enhancement devices.

2. Description of the Related Art

There are numerous portable acoustic "headphone style" listening enhancement devices in the prior art, such as U.S. Pat. Nos. 5,965,850 and 6,082,486, and the references described therein. These "headphone style" devices have cups or scoops designed to capture and funnel sound waves directly into a user's ear. One disadvantage of these prior designs is user discomfort. Although the weight and rigidity of the materials employed by these devices may be the cause of some discomfort, the primary discomfort results from the lack of aesthetic appeal. A user is forced to wear a hat or large band that limits or compresses a user's hair style, to support a pair of large "ears" that are often uncomfortably pressed against the wearer's ears.

Devices that integrate listening enhancement devices into stationary objects, such as seats, also exist in the prior art. Earlier inventions, such as the king's throne described by Kenneth Berger in *THE HEARING AID: IT's OPERATION AND DEVELOPMENT,* page 22 (1974), were typically too bulky and expensive for ordinary use. More recent inventions, such as U.S. Pat. Nos. 2,908,766 and 3,512,605, incorporate electrical hearing enhancement devices into seats, but these modem developments do not do much to alleviate the earlier problems. Electrically powered listening enhancement devices are costly to operate and typically cost more to construct than acoustic hearing enhancement devices. Building the listening enhancement device directly into the structure of the seat limits portability and increases the overall investment necessary to obtain the device. The relatively high cost and bulkiness of the prior art "combination" listening enhancement devices continues to limit their usefulness.

SUMMARY OF THE INVENTION

A continuing need exists for a relatively cheap and portable acoustic hearing enhancement device which is not uncomfortable for the user. The present invention substantially fulfills this need by providing an acoustical hearing enhancement device which does not require the use of electricity to operate, which is portable and versatile, which is not prohibitively expensive or difficult to manufacture and repair, which is aesthetically pleasing and comfortable for the user, and which does not require any permanent structural modifications to be made for each individual user.

To attain these ends, the preferred embodiment of the present invention comprises a pair of cup-shaped sound reflecting devices, which are positionable behind a user's ears on the front surface of a seat's headrest through the use of flexible support bands that are attached to the outer shell of the sound reflecting devices. The sound reflecting devices are constructed with an opening to the front of the user which collects sound from the direction the user is facing and directs the sound towards the user's ears. The cup-shaped sound reflecting devices are held in position near the user's ears through the use of the flexible support bands that are attached to the outer shell of the sound reflecting devices.

The flexible support bands are designed to lay over the top of a seat's headrest and to maintain their positions through the weight of the support bands and the friction between the support bands and the top of the headrest. In the preferred embodiment, the sound reflecting devices maintain their relative positions on each side of the user through the use of a positioning band, which maintains separation between and connects the support bands attached to the sound reflecting devices on each side of the user. Adding a buckle to the positioning band permits users to adjust the distance between the sound deflecting devices in this embodiment of the invention to accommodate varying head sizes, or to accommodate preferences for the proximity of the sound reflecting devices to the ears.

One aspect of the present invention is an acoustic sound collector positionable proximate to an ear of a user seated in a seat having a headrest to receive sound and to direct the sound towards the user's ear. The headrest has a front portion, a top portion, and a back portion. The sound collector comprises a sound reflecting device that has an outer shell. A support band is attached to the outer shell of the sound reflecting device. The support band comprises a flexible material that is conformable to a shape of the top of the headrest of the seat, to enable a user to adjust the position of the sound reflecting device on the front portion of the headrest. Preferably, the support band comprises a cloth web. The cloth web has sufficient weight such that the support band maintains the position of the sound reflecting device with respect to the top of the headrest using only weight and friction. Alternatively, the support band comprises a malleable material that is covered with a cushioning material. The malleable material maintains its shape to hold the position of the sound reflecting device with respect to the top of the headrest. Preferably, two sound collectors are provided, with a respective sound collector positioned near each ear of the user. A positioning band advantageously aligns the sound collectors with respect to the ears of the user. Preferably, the positioning band is adjustable for positioning the sound collectors horizontally to accommodate varying head sizes or preferences for the proximity of the sound reflecting devices to the ears.

Another aspect of the present invention is a passive hearing enhancement system for a person seated in a chair having a headrest. The hearing enhancement system comprises a support band positionable over the top of the headrest of the chair. The support band has a first portion that extends behind the headrest of the chair and has a second portion that extends in front of the headrest of the chair. A sound reflecting device is attached to the second portion of the support band. The position of the sound reflecting device with respect to the top of the headrest is adjustable by moving the support band to vary the length of the first portion of the support band extending behind the headrest and to vary the length of the second portion of the headband extending in front of the headrest.

Another aspect of the present invention is a method of enhancing the hearing of a person seated in a chair having a headrest. The method comprises placing a support band over the top of the headrest of the chair. The support band has a first portion that extends behind the headrest of the chair and has a second portion that extends in front of the headrest of the chair. The second portion of the support band has a sound reflecting device attached thereto. The method further comprises adjusting the length of the first portion of the support band extending behind the headrest and the length of the second portion of the headband extending in front of the headrest to establish a vertical position of the sound reflecting device with respect to an ear of a person seated in the chair.

The disclosed embodiments of the present invention are portable, easy to implement and construct, comfortable for the user, and more aesthetically acceptable because they are not worn by the user. The flexible bands and sound reflecting devices may be compacted into a highly portable configuration. The materials used in the preferred embodiment are inexpensive and easy to maintain. Further, the headrest of the seat does not have to be modified in any manner to accommodate the hearing enhancement device. Placing the acoustic sound collectors on a stationary device such as a seat's headrest, rather than on the user, reduces the user's physical discomfort and is also less objectionable aesthetically.

BRIEF DESCRIPTION OF THE DRAWINGS

The structure and advantages of the present invention will become more apparent in view of the detailed descriptions of the preferred embodiments thereof with reference to the attached drawings in which.

DETAILED DESCRIPTION OF THE PREFERRED EMBODIMENT

Hereinafter, embodiments of the present invention will be described in detail with reference to the attached drawings.

Figure 1A:
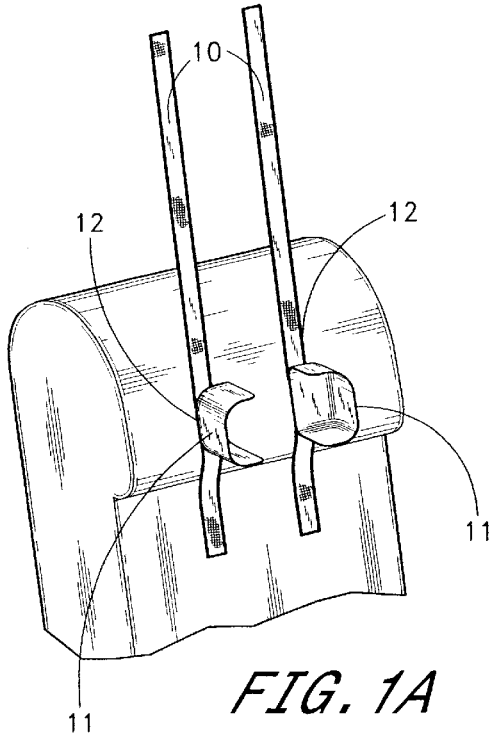
FIG. 1A is a perspective view of a preferred embodiment of the invention showing support bands attached to sound reflecting devices.

FIG. 1A is a perspective view of a first embodiment of the invention showing support bands 10 attached to sound reflecting devices 11 at attachment locations 12 on the backs of the devices 11. The support bands 10 may be constructed out of various materials. A flexible material may advantageously be employed to conform the support bands 10 to the headrest. The material used for the support bands 10 advantageously has sufficient weight to hold the sound reflecting devices 11 in place next to the user's ear through counterweighting and friction force effects. Ordinary thick cloth or similar web-like material, such as that used for cloth belts, may suffice, depending on the weight of the material used for the sound reflecting devices 11. Alternatively, a malleable material, such as malleable metal may be advantageously used for the support bands 10. A malleable metal can be conformed to the shape of the top of the headrest, and will stay in that shape to thereby further resist movement. The malleable material may be covered with cloth or similar cushioning material for user comfort and for aesthetic purposes. To increase the friction between the support bands 10 and the headrest, the side of the support bands 10 which contacts the headrest may be roughened or covered with a coarse nonabrasive material.

The sound reflecting devices 11 in FIG. 1A are advantageously constructed of various materials in various different ways. The functionality of the devices can be readily implemented by simple structures that can be constructed with inexpensive tooling. The sound reflecting devices may be carefully designed into an acoustical form that mechanically transmits sound into the user's ear in a manner that "preserves the phase-coherency, frequency balance, and even the proper, upright vertical sonic image relationships in the sound waves" as taught by U.S. Pat. No. 4,997,056. Such complexity is not necessary, however, for the embodiments of the present invention.

A much simpler design for the sound reflecting devices 11 can be advantageously used while maintaining the acoustic benefits provided by the devices 11. For example, an ordinary cup-shaped device or a device having a concave surface suffices to provide significant hearing enhancement with very little complexity. The sound reflecting devices 11 may be constructed of any material, but for the purposes of user safety and ease of portability, a lightweight and flexible material such as soft plastic, foam, or rubber is advantageously used. The material used in ordinary household items may be employed for this purpose, such as the high density polyethylene that is used in conventional containers for storing water or other liquids. One of ordinary skill in the art will appreciate that numerous variations are possible, especially in light of the plethora of design variations in the prior art for the "headphones" used in the "headphone style" hearing enhancement devices.

The support bands 10 may be attached to the sound reflecting devices 11 at the locations 12 by varying means. For example, the outer shell of each sound reflecting device 11 can include a strip of hooks that engage a corresponding strip of fiber loops on the respective support band 10. Such material is commercially available as VELCRO® hook and loop fastening material. Alternatively, each sound reflecting device 11 can have a first part of a snap fastener that engages a second part of a snap fastener on the respective support band 10. In particularly inexpensive devices, the sound reflecting devices 11 are advantageously attached to the support bands 10 using glue, epoxy or other permanent attachment material.

In the embodiment of FIG. 1A, the two acoustic reflecting devices can be spaced apart from each other by a distance selected to accommodate the size of the user's head and can be positioned up and down with respect to the headrest to accommodate the height and sitting position of the user. It should be readily understood that a user desiring to have hearing enhancement for only one ear, can position only a single one of the acoustic reflecting devices 11 and its associated support band 10 on the headrest.

Figure 1B:
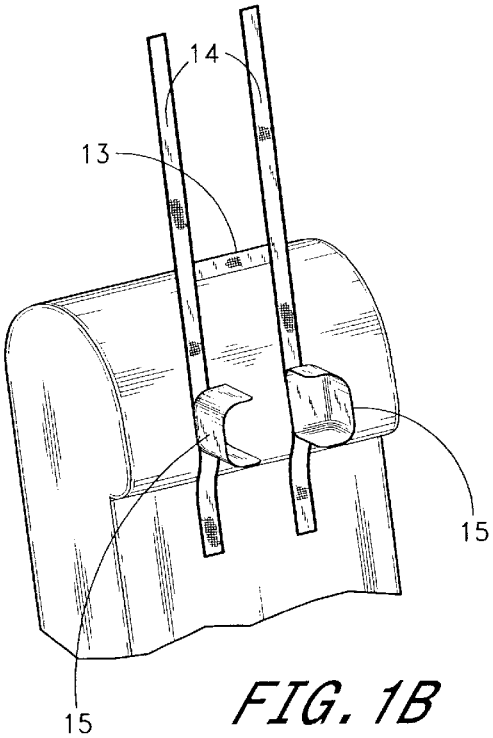
FIG. 1B is a perspective view of an alternative preferred embodiment of the invention showing a positioning band maintaining separation between and connecting two support bands with attached sound reflecting devices.

FIG. 1B is a perspective view of a second embodiment of the invention showing a positioning band 13 that connects a pair of support bands 14 to maintain a maximum separation between the two support bands 14. Thus, the sound reflecting devices 15 attached to the support bands 14 are kept from moving too far away from the user's ears to be effective. The positioning band 13 is advantageously constructed of a flexible material that maintains a maximum distance between the two side bands sufficient to accommodate an ordinary user. For example, the positioning band may be constructed from the same type of flexible material used to construct the support bands 14. A flexible, web-like positioning band 13 will serve as a guide in aligning the support bands 14, while increasing the friction between the headrest and the bands. A soft, flexible band also ensures comfort for the user if the user's head contacts the positioning band 13 when using the invention. A flexible band also renders the invention more compact and easier to transport. Alternatively, the positioning band 13 may be semi-rigid to also maintain a minimum distance between the support bands 14.

Figure 1C:
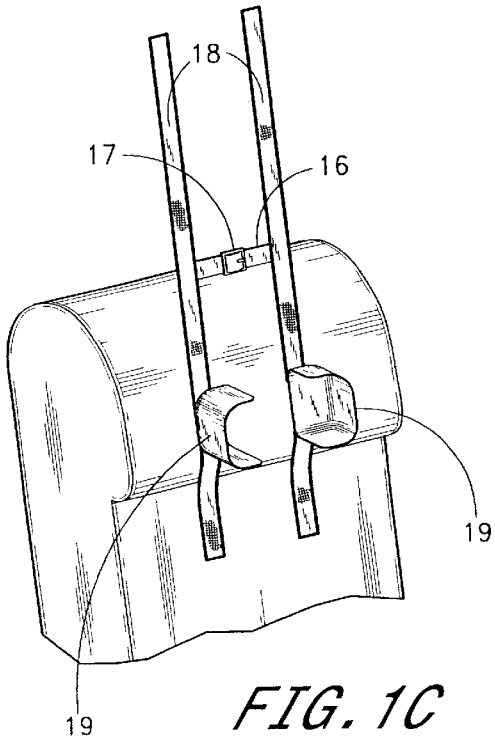
FIG. 1C is a perspective view of a further alternative preferred embodiment of the invention showing an adjustable length positioning band maintaining separation between and connecting two support bands with attached sound reflecting devices.

FIG. 1C is a perspective view of a third embodiment of the invention showing an adjustable length positioning band 16 connecting a pair of support bands 18. A sound reflecting device 19 is attached to each support band 18. This alternative embodiment of the positioning band allows the distance between the support bands to be adjusted for users with varying head sizes or with varying preferences for the proximity of the sound reflecting devices 19 to the user's ears. The length of the positioning band 16 is adjusted by a buckle 17 that may be constructed of flexible plastic or other flexible material to help ensure the comfort of the user. In one embodiment, the adjustment buckle 17 is located proximate to one of the sound reflecting devices 19 so that it is not likely to contact the back of the user's head. Alternatively, as illustrated in FIG. 1C, the positioning band 16 and the adjustment buckle 17 are located sufficiently far from the sound reflecting devices 19 that the user's head is unlikely to contact the adjustment buckle 17.

Figure 2A:
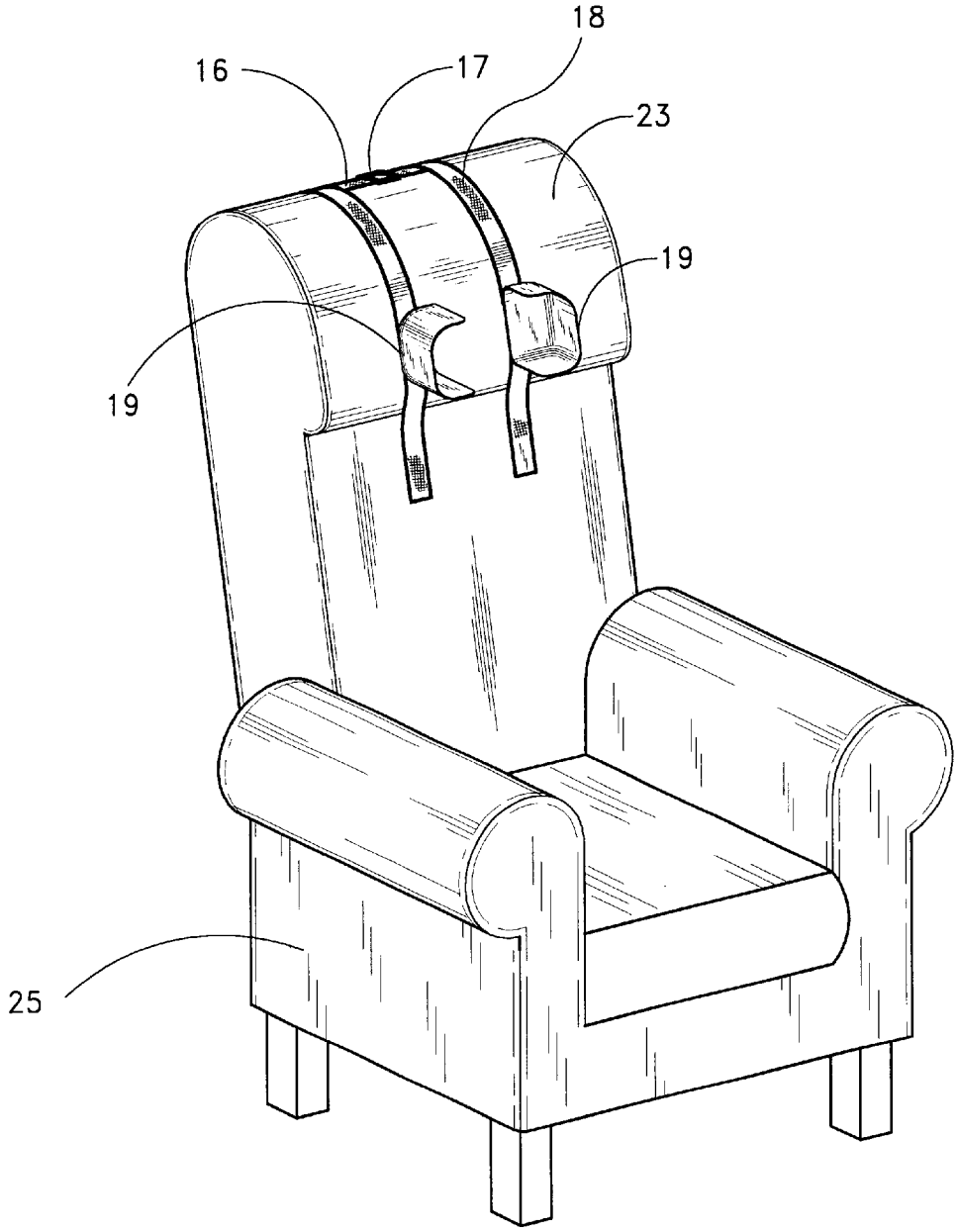
FIG. 2A is a perspective view of a preferred embodiment of the present invention placed on the headrest of a seat.

FIG. 2A illustrates a perspective view of the embodiment of FIG. 1C placed on the headrest 23 of a seat 25. As used herein, the term "seat" refers to any object upon which a user may sit or otherwise rest. The term "headrest" as used herein refers to any stationary object that is capable of supporting, bolstering, or cushioning a user's head when the user is seated in the seat. In FIG. 2A, the headrest 23 is the upper portion of the back of the seat 25.

In FIG. 2A, the sound reflecting devices 19 are held in place by the attachment to support bands 18. The support bands 18 and the positioning band 16 are held in place by the counterbalancing weight of the portions of the support bands 18 behind the headrest 23 and weight of the sound reflecting devices 19 and the portions of the support bands 18 in front of the headrest 23. In addition, the friction developed between the fabric of the seat's headrest 23 and the fabric of the support bands 18 also inhibits movement of the sound reflecting devices 19 once positioned on the headrest 23. Although the seat depicted in the drawing has a fabric covered, cushioned headrest useful for developing such friction, one of ordinary skill in the art could easily modify the present invention to work with other seats. For example, in a conventional straightback chair having a thin headrest the free ends of the support bands 18 may be interconnected by using VELCRO® loop and hook material or by use of buckles (not shown) to secure the sound reflecting devices 19 in a fixed position.

Figure 2B:
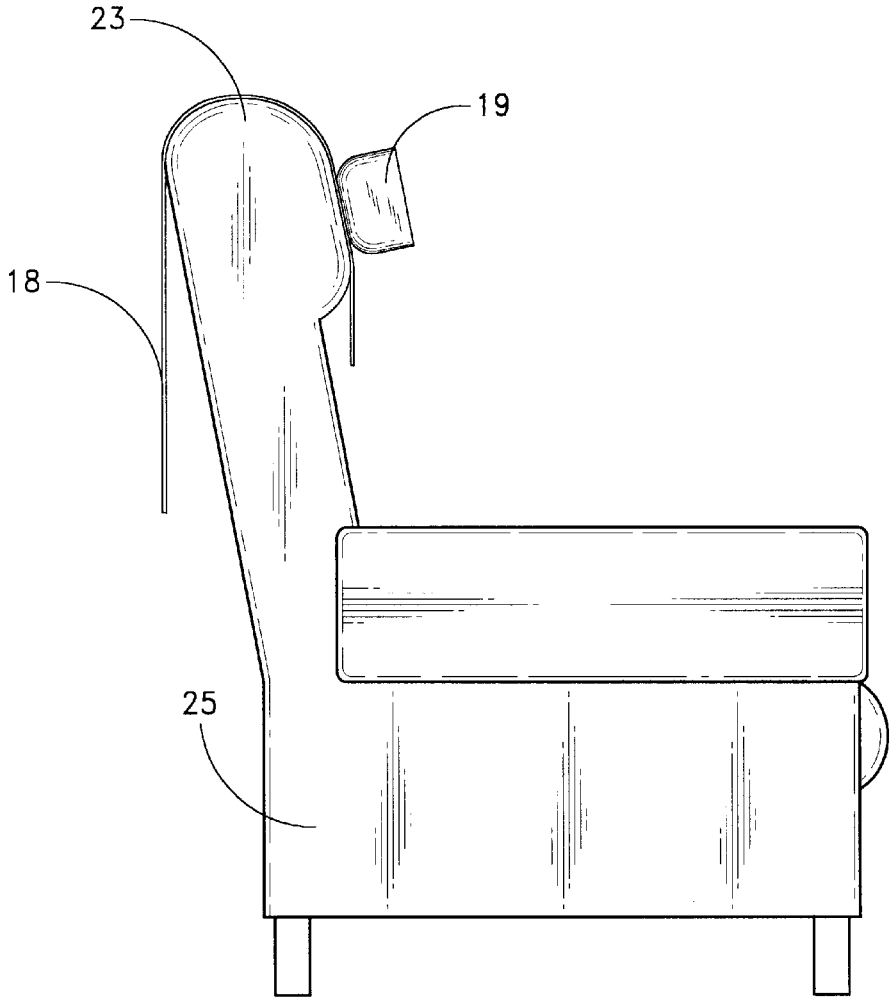
FIG. 2B is a side view of the preferred embodiment of FIG. 2A placed on the headrest of a seat.

FIG. 2B is a side view of the embodiment of FIG. 1C placed on the headrest 23 of the seat 25. Although the elements of FIG. 2B are numbered to correspond to FIG. 1C, it should be understood that the embodiments of FIG. 1A and FIG. 1B can also be represented by a similar side view. The illustration in FIG. 2B can also represent a single sound reflecting device for the right ear of a user.

The side view depicted in FIG. 2B further demonstrates how the weight of the portion of the support band 18 that hangs over the back of the headrest 23 counterbalances the weight of the sound reflecting device 19 and the portion of the support band 18 that is in the front of the headrest 23. FIG. 2B also shows that for the cushioned headrest 23, the support band 18 has significant surface contact with the headrest 23 to produce friction to assist in holding the sound reflecting device 19 in position on the headrest 26.

Figure 3:
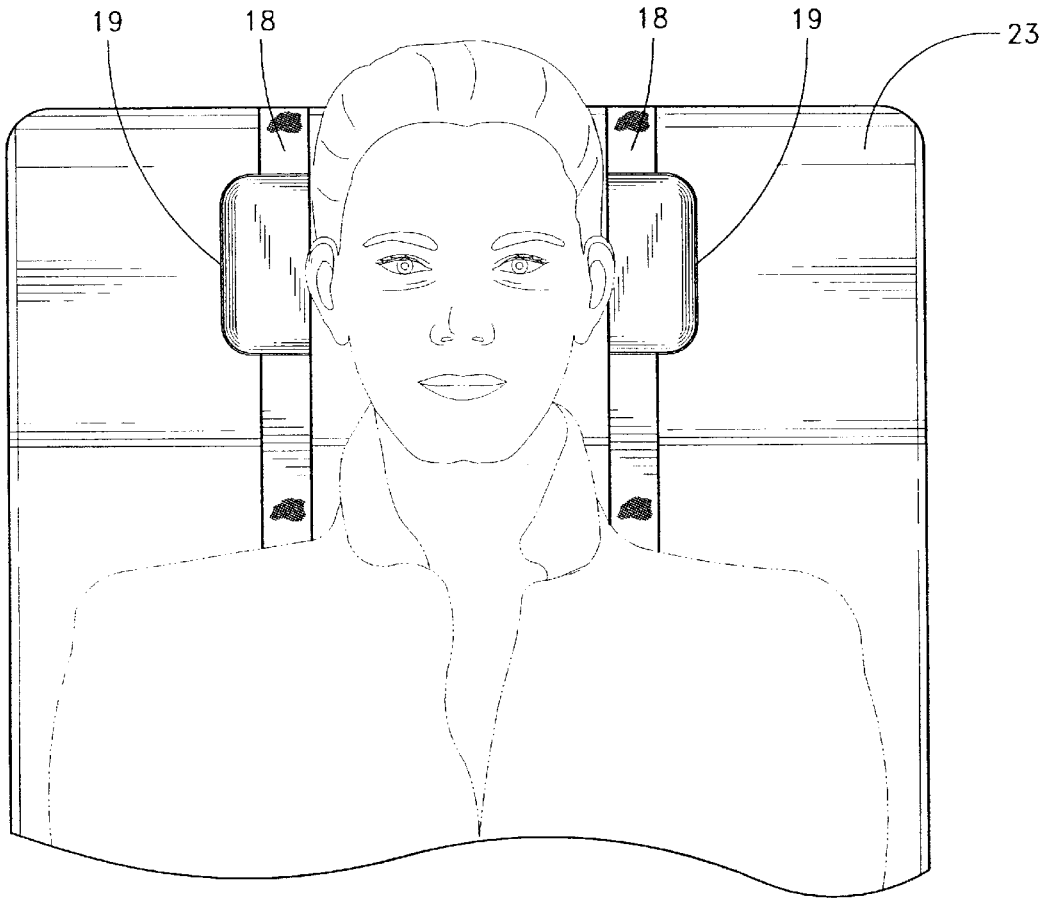
FIG. 3 is a front elevation view of a user leaning against the headrest of a seat and using a preferred embodiment of the invention.

FIG. 3 illustrates a partial front elevation view of the embodiment of FIG. 1C in place on the headrest 23 of the chair 25 with a person's head positioned between the two sound reflecting devices 19. As discussed above, the vertical and horizontal positions of the sound reflecting devices 19 can be varied to accommodate the positions of the user's ears on the headrest 23.

While preferred embodiments of this invention have been disclosed herein, those skilled in the art will appreciate that changes and modifications may be made therein without departing from the spirit and scope of the invention as defined in the appended claims.

What is claimed is:

1. An acoustic sound collector positionable proximate to an ear of a user seated in a seat having a headrest to receive sound and to direct the sound towards the user's ear, the headrest having a front portion, a top portion, and a back portion, the sound collector comprising:

a sound reflecting device comprising an outer shell; and a support band attached to the outer shell of the sound reflecting device, the support band comprising a flexible material that is conformable to a shape of the top of the headrest of the seat, to enable a user to adjust the position of the sound reflecting device on the front portion of the headrest.

2. The sound collector of claim 1, wherein the support band comprises a cloth web, the cloth web having sufficient weight such that the support band maintains the position of the sound reflecting device with respect to the top of the headrest using only weight and friction.

3. The sound collector of claim 1, wherein the support band comprises a malleable material, covered with a cushioning material, that maintains the position of the sound reflecting device with respect to the top of the headrest.

4. The sound collector of claim 1, wherein:

a sound collector is positioned near each ear of the user; and a positioning band aligns the sound collectors with respect to the ears of the user.

5. The sound collector of claim 4, wherein the positioning band is adjustable for positioning the sound collectors to accommodate varying head sizes or preferences for the proximity of the sound reflecting devices.

6. A passive hearing enhancement system for a person seated in a chair having a headrest, comprising:

a support band positionable over the top of the headrest of the chair, the support band having a first portion that extends behind the headrest of the chair and having a second portion that extends in front of the headrest of the chair;

a sound reflecting device attached to the second portion of the support band, the position of the sound reflecting device with respect to the top of the headrest adjustable by moving the support band to vary the length of the first portion of the support band extending behind the headrest and to vary the length of the second portion of the headband extending in front of the headrest.

7. A method of enhancing the hearing of a person seated in a chair having a headrest comprising:

placing a support band over the top of the headrest of the chair, the support band having a first portion that extends behind the headrest of the chair and having a second portion that extends in front of the headrest of the chair, the second portion having a sound reflecting device attached thereto; and adjusting the length of the first portion of the support band extending behind the headrest and the length of the second portion of the headband extending in front of the headrest to establish a vertical position of the sound reflecting device with respect to an ear of a person seated in the chair.

* * * * *